United States Patent [19]

Josef et al.

[11] Patent Number: 4,955,219

[45] Date of Patent: Sep. 11, 1990

[54] ROCK BOLT

[75] Inventors: Moshe Josef, Bruma; David Wiesenfeld, Givataim, both of South Africa

[73] Assignee: Videx-Wire Products (Proprietary) Limited, Transvaal, South Africa

[21] Appl. No.: 390,904

[22] Filed: Aug. 8, 1989

Related U.S. Application Data

[63] Continuation-in-part of Ser. No. 119,441, Nov. 12, 1987, abandoned.

[30] Foreign Application Priority Data

Nov. 14, 1986 [ZA] South Africa ..... 86/8649
Sep. 11, 1987 [ZA] South Africa ..... 87/6810

[51] Int. Cl.[5] ..... B21H 8/02
[52] U.S. Cl. ..... 72/187; 72/198
[58] Field of Search ..... 72/185, 187, 191, 197, 72/198, 240

[56] References Cited

U.S. PATENT DOCUMENTS 1,817,115 8/1931 Wakefield ..... 72/240
2,156,584 5/1939 Benedetti ..... 72/240
2,911,865 11/1959 Brickman ..... 72/198
3,410,126 11/1968 Baker ..... 72/240
3,468,151 9/1969 Diolot ..... 72/240
3,742,747 7/1973 Fukushima et al. ..... 72/191
4,584,247 4/1986 Mulholland ..... 10/152 R
4,649,729 3/1987 McDowell et al. ..... 72/185

*Primary Examiner*—Lowell A. Larson
*Attorney, Agent, or Firm*—Nixon & Vanderhye

[57] ABSTRACT

A method of making a rock bolt (1) with a thread on a section thereof comprising the steps of; providing a metal bar of circular or near circular cross-section having a diameter which is substantially equal to the pitch diameter of the thread to be provided thereon; passing the bar in a single pass between a pair of rolls (8, 9) to pinch the bar at intervals to cold form protrusions (2) spaced from one another in staggered formation on opposite sides of the bar along a selected section thereof; displacing one or more of said rolls (8, 9) away from the other at a selected time to ensure that said protrusions are formed only on said selected section of bar; straightening the bar in its cold condition; and cold rolling in a thread (4) with said pitch diameter on a further selected section of the bar which is free of the said protrusions.

6 Claims, 6 Drawing Sheets

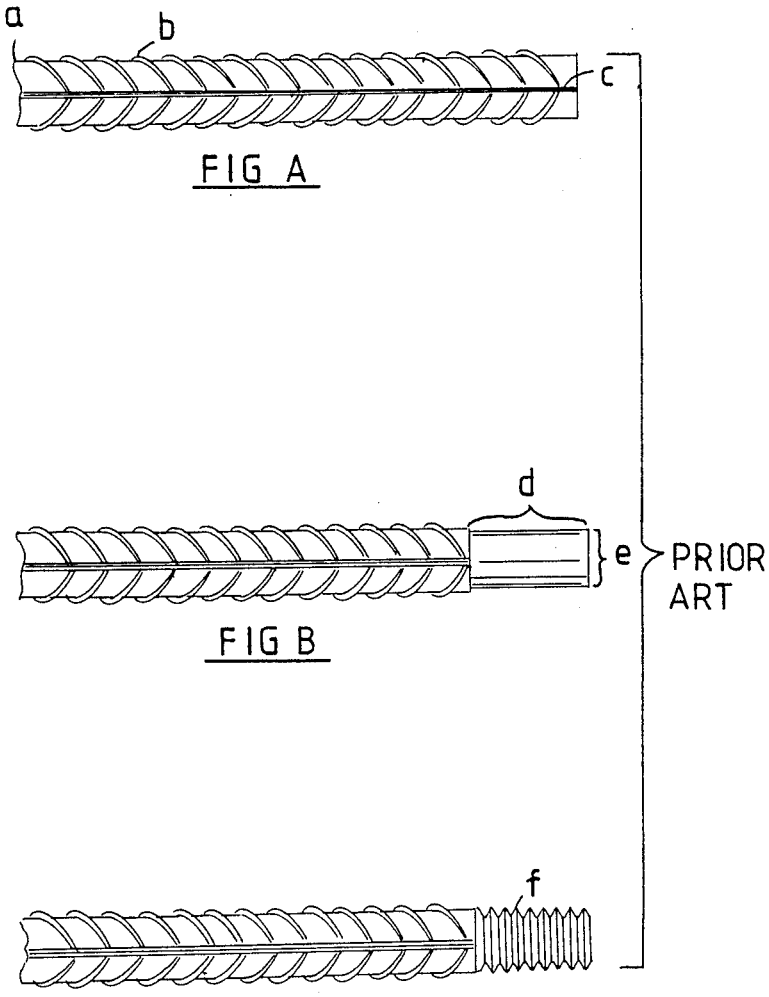
FIG A
FIG B
FIG C

ROCK BOLT

This application is a continuation-in-part of application Ser. No. 07/119441 filed on Nov. 12, 1987 now abandoned.

FIELD OF THE INVENTION

This invention relates to a rock bolt and more particularly, but not exclusively, to a rock bolt for use in underground mining operations.

BACKGROUND TO THE INVENTION

Many different kinds of rock bolts are used to secure rock strata underground. One kind comprises a length of reinforcing bar having ribs along its length. The ribs enhance the anchoring ability of the bolt. In the case where a resin with a catalyst is used to secure the bolt in a hole in the rock matrix, the bolt is rotated in the hole to mix the resin and the ribs also serve the purpose of assisting the mixing of the resin. However, known ribbed formations on rock bolts do not provide good mixing characteristics.

The end of the bolt which is intended to project from the rock face has a rolled thread thereon which receives a nut used to tension the bolt. The bar from which such a prior art rock bolt is made is manufactured in a steel mill and is supplied with the ribs formed on the whole length of the bar. Thus, in order to provide the rolled thread on the bolt, the bolt has to be machined to remove the ribs on a section thereof and to ensure that such section has a circular cross-section. Such a machining operation adds to the cost of the prior art rock bolt.

U.S. Pat. No. 4,584,247, to Mulholland proposes a way of overcoming the abovementioned problem. Mulholland teaches a method of providing a threaded portion on a hot rolled steel bar having chevron patterned ribs thereon. The method involves selecting a ribbed bar having an overall average cross-sectional area substantially the same as the average cross-sectional area that is desired for the threaded section of the bar. Such a bar is inserted on to a thread rolling machine and the threaded section is roll formed on the bar. The ribs are not removed before the threaded section is formed. In other words the thread in the Mulholland teaching is rolled onto the bar despite the presence of the ribs thereon. This method has substantial disadvantages and cannot be put into effective practice. Because of the presence of the ribs the bar is not circular in cross-section which means that the thread formed thereon cannot be circular. This arises from the fact that from place to place on the bar there is material "missing" from the thread. Such a thread cannot meet standard thread specifications and is not appropriate for the high tensile requirements for rock bolts in underground mining operations. Furthermore, the ribs of the bar according to the Mulholland teaching can at best only have a very slight depth. If the depth of the ribs is increased it will become a matter of impossibility to roll a thread on the bar which is not totally defective. Because the ribs can only have a slight depth the bar suffers from a poor anchoring ability, for it is primarily the ribs on a bar of this kind which give it its anchoring ability. A further consequence of a bar with ribbing of a slight depth is that it provides poor mixing in the case of resin anchoring of the bar.

It is an object of the invention to lessen the problems associated with prior art rock bolts. In this specification, the term "pitch diameter", in relation to a straight thread, means the diameter of an imaginary co-axial cylinder, the surface of which passes through the thread profiles at such points as to make the width of the groove equal to one half of the basic pitch of the thread. On a perfect thread this occurs at the point where the width of the thread and groove are equal.

The term "bar" when used in this specification includes a pipe and a bar with an axial bore.

SUMMARY OF THE INVENTION

According to the invention, a method of making a rock bolt with a thread on a section thereof comprising the steps of;

providing a metal bar of circular or near circular cross-section having a diameter which is substantially equal to the pitch diameter of the thread to be provided thereon;

passing the bar in a single pass between a pair of rolls to pinch the bar at intervals to cold form protrusions spaced from one another in staggered formation on opposite sides of the bar along a selected section thereof;

displacing one or more of said rolls away from the other at a selected time to ensure that said lobes are formed only on said selected section of bar;

straightening the bar in its cold condition; and cold rolling a thread with the said pitch diameter on a further selected section of the bar which is free of the said protrusions.

This method obviates the need for machining the bar before forming the thread thereon. As will become evident in the subsequent description, the method also results in a saving of material without reducing the yield or tensile load-carrying ability of the rock bolt.

In one form the metal bar is first cut to a discrete length, is then advanced through means forming the series of protrusions on the selected section of the bar, and is thereafter advanced through straightening means to straighten it, whereafter thread is formed on the further selected section of the bar.

In another form a continuous length of the metal bar is first advanced through means forming the series of protrusions on selected sections of the bar, the continuous length is thereafter advanced through straightening means to straighten it, whereafter the bar is cut to required lengths and thread is formed on a selected section of each length.

Preferably the bar is straightened in two planes by passing the bar sequentially through two sets of rollers, the rollers of one set being located at right angles to those of the other set, the rollers of each set being located in staggered, opposed relationship.

In a preferred form wherein one of said rolls, being mounted on a shaft, is displaced away from the other of said rolls by pivotting said shaft about a pivot.

The invention also provides apparatus for making a rock bolt from a metal bar comprising;

a pair of rolls;

means for driving said pair of rolls about their axes in opposite directions;

each roll having a channel formed in its surface facing the other roll, said channels defining a passage for receiving said metal bar in lengthwise fashion, each roll having formations along its periphery which align periodically with similar formations on the other roll in the nip of the rolls when they are rotated in opposite directions, one of said rolls being mounted on a shaft displaceable about a pivot; and means for displacing said shaft about said shaft so as to displace said one roll away from the other roll.

The formations on said rolls are preferably pegs mounted in holes in said rolls.

BRIEF DESCRIPTION OF THE DRAWINGS

A preferred embodiment of the invention will now be described by way of example with reference to the accompanying drawings in which.

FIGS. A to C illustrate a prior art method of making a rock bolt.

With reference to FIG. A, a prior art steel bar (a) is provided, and is cut to the required length. The bar (a) carries a series of diametrically opposed inclined ribs (b) separated by a pair of longitudinal ribs (c) of which only one is shown. The ribs (b), (c) are formed conventionally by hot rolling during manufacture of the bar (a) in a steel mill. The next step in making the prior art rock bolt is to machine or shave the bar (a) as shown in FIG. B along a section (d) of its length to remove the ribs (b), (c) and to provide the section (d) with a circular cross-section of diameter (e). Thereafter a thread (f) is rolled onto the section (d) of the bar as shown in FIG. C to complete the rock bolt. It will be appreciated that the tensile strength of the bolt is determined by the minimum diameter of the thread (f) of the bolt, since that is its smallest diameter.

DESCRIPTION OF PREFERRED EMBODIMENTS

Figure 1A:
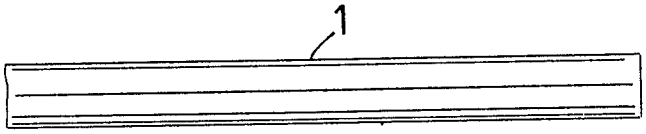
FIGS. 1*a* to 1*c* illustrate steps in making a rock bolt according to the method of the invention.
Figure 1B:
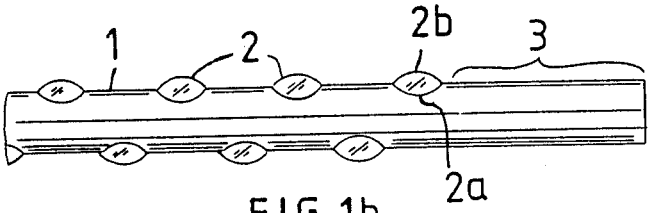
Figure 1C:
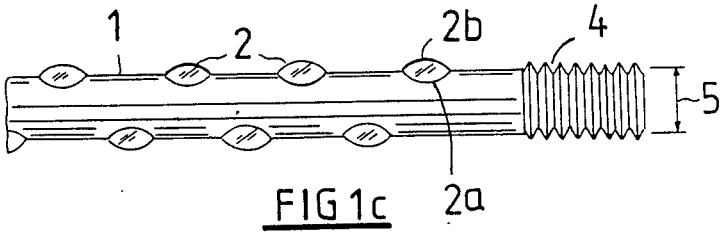

With reference to FIGS. 1*a* to 1*c,* a rock bolt according to the invention is formed from a steel bar 1 of circular or near circular cross-section. The first step in making a rock bolt from the bar 1 is to form a series of protrusions in the form of flat lobes 2 in the bar by a method which will be more fully described hereunder. A section 3 of the bar which is to be threaded is left free of lobes 2. After the lobes 2 have been passed through a straightening station to straighten it, a thread 4 is cold rolled on to the section 3 of the bar. The pitch diameter of the thread 4 is indicated by numberal 5 and is substantially equal to the diameter of the bar.

In this embodiment of the invention, as most clearly shown in FIGS. 1*b* and 1*c,* the lobes 2 are arranged in staggered formation along the length of the bar 1. The sides 2*a,* 2*b* of each lobe respectively nearest and furthest the axis of the bar are arcuate so that each lobe has a generally elliptical outline in plan view.

In an alternative method the thread 4 may first be rolled on to the section 3 of the bar after which the lobes 2 may be formed on the remainder of the bar. Thereafter the bar may be straightened.

The manner of forming the lobes 2 on the bar and the apparatus used for this purpose is illustrated in FIGS. 2 to 5. The apparatus, indicated generally by numeral 6, comprises a frame 7 having a pair of rolls 8, 9 mounted thereon for rotation about horizontal axes. An electric motor 10 is provided to drive the rolls about their respective axes in opposite directions. The drive is effected through a multiple groove pulley 11.

Figure 3E:
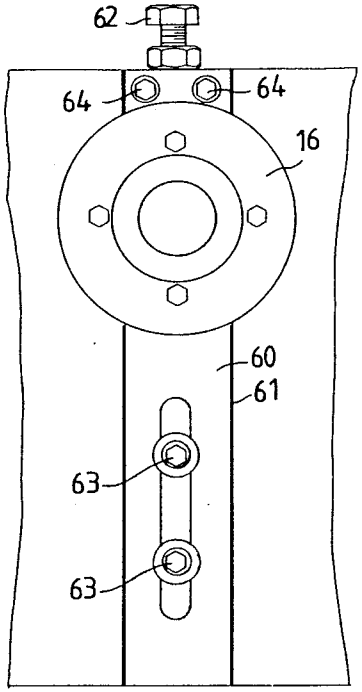
FIGS. 3*a* to 3*e* are enlarged views of parts of the apparatus of FIGS. 2*a* and 2*b.
Figure 3C:
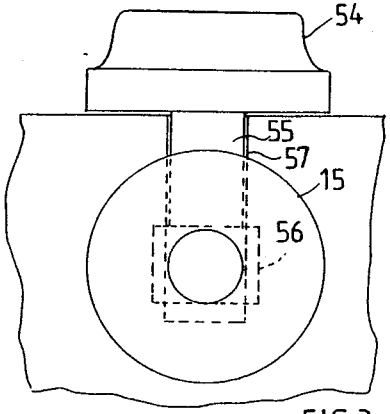
Figure 3D:
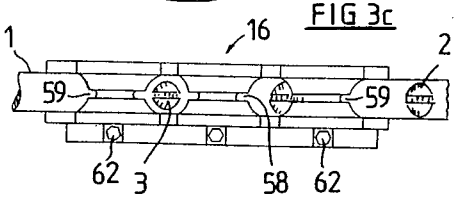
Figure 3B:
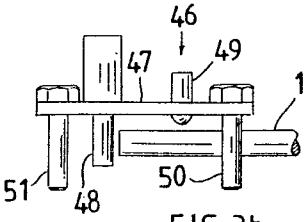
Figure 3A:
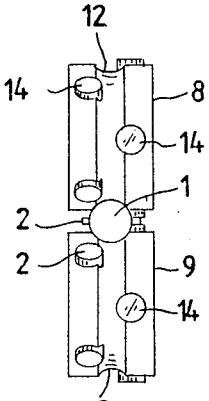

The rolls 8, 9 have grooves 12, 13 formed respectively in their edges facing one another, which grooves define a passage for receiving the bar 1 in lengthwise fashion (FIGS. 3*a,* 4). Each roll 8, 9 has a plurality of pegs 14 mounted thereon along its periphery. The pegs 14 are arranged in such a manner that corresponding pegs on the rolls periodically align in the nip of the rolls when they are rotated. The pegs 14 are preferably of circular cross-section, mounted in holes in the rolls 8, 9.

Figure 2A:
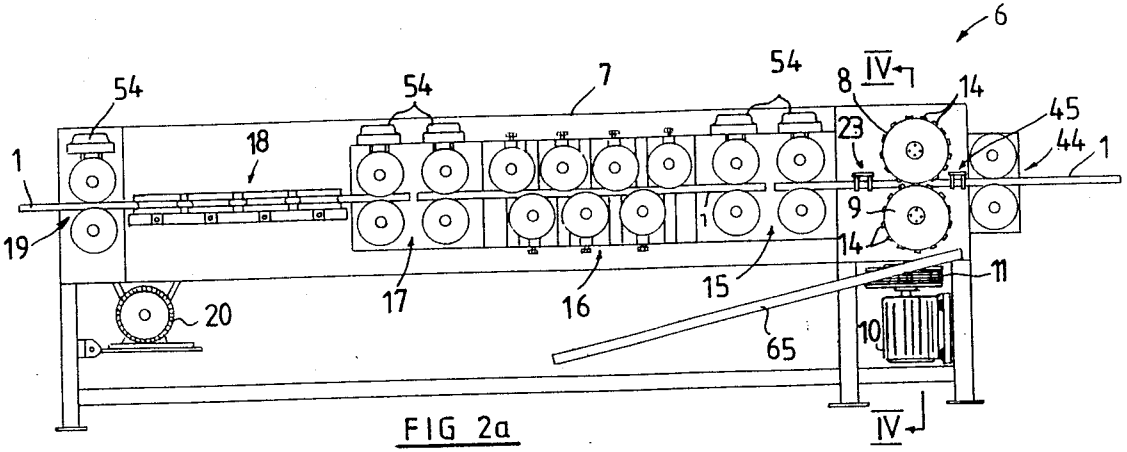
FIG. 2*a* and 2*b* are schematic elevation and plan views respectively of apparatus used to carry out the method of the invention.

Alongside the rolls 8, 9 there is a set of driven rollers 15 followed by a set of straightening rollers 16 which are arranged in opposed, staggered formation (FIGS. 2*a,* 2*b*). Alongside the straightening rollers 16 there is a further set of driven rollers 17. The sets of rollers 15, 16 and 17 are mounted for rotation about horizontal axes. Alongside the driven rollers 17 there is a further set of straightening rollers 18 arranged in opposed, staggered formation and mounted for rotation about vertical axes. Finally, alongside the straightening rollers 18 there is a set of driven rollers 19 mounted for rotation about horizontal axes. The sets of driven rollers 15, 17 and 19 are driven by an electric motor 20.

Figure 4:
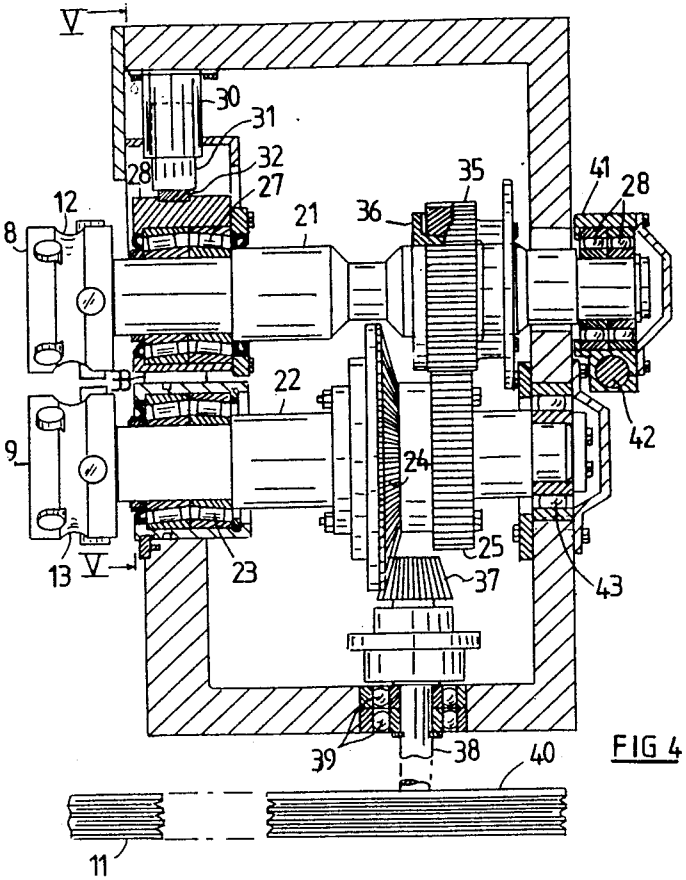
* and FIG. 4 is a section of part of the apparatus of FIG. 2*a* taken along lines IV—IV in FIG. 2*a,* with parts thereof omitted for clarity.

In this embodiment of the invention the rolls 8, 9 are mounted on shafts 21, 22 respectively (FIG. 4). The shaft 22 is rotatably mounted on a self-aligning roller bearing 23 at its forward end and on a ball bearing 43 at its inner end. The bearings 23, 43 are mounted on the frame 7 of the apparatus 6. Between its ends the shaft 22 carries a crown gear 24 and a spur gear 25. The shaft 21 is rotatably mounted in a self-aligning roller bearing 27 at its forward end and on a set of ball bearings 28 at its inner end.

Figure 5:
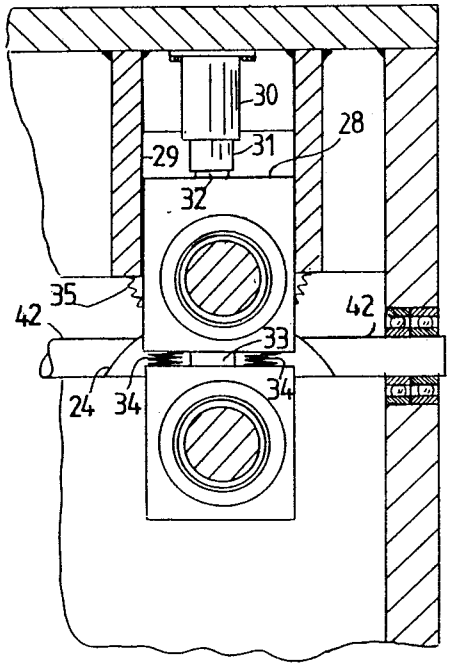
FIG. 5 is a section of part of the apparatus shown in FIG. 4 taken along line V—V.

The roller bearing 27 is contained in a housing 28 which is movable in a slide 29 mounted on the frame 7 (FIG. 5). A hydraulic ram 30 is located above the housing 28 of the roller bearing 27 and has a piston 31 which acts against a hardened metal footpiece 32 mounted on the housing 28. At its lower end the housing 28 of the roller bearing 27 bears on a hardened metal spacer 33. On each side of the spacer 33 a coil spring 34 is provided which tends to urge the housing upwardly. Between its ends the shaft 21 carries a spur gear 35 which meshes with the spur gear 25 on the shaft 22. The spur gear 35 is mounted on the shaft 21 by means of cotters 36 to permit the setting between the gears 25, 35 and hence the setting between the rolls 8, 9 to be adjusted. The crown gear 24 meshes with a pinion 37 carried on a shaft 38 mounted on a set of roller bearings 39 and connected to a fly wheel 40. The fly wheel 39 is belt driven from the pulley 11 of the electric motor 10.

The set of roller bearings 28 located at the inner end of the shaft 21 is housed in a housing 41 which is mounted on a pivot 42. With this arrangement the shaft 21 and roll 8 are displaceable upwardly and downwardly about the pivot 42. When the hydraulic ram 30 is activated the piston 31 bears on the footpiece 32 on the housing 28 and forces the shaft 21 downwardly until the lower end of the housing 28 seats on the metal spacer 33. The metal spacer 33 therefore serves to determine the gap in the nip of the rolls 8, 9 and in order to create different gaps spacers 33 of different heights may be used. When the hydraulic pressure in the ram 32 is released the springs 34 acting against the housing 28 displace the shaft 21 upwardly and hence displace the roll 8 away from the roll 9.

The pinion 37 serves to drive the shaft 22 and hence the roll 9 through the crown gear 24. At the same time the spur gear 25 drives the shaft 21 and hence the roll 8 in an opposite direction through the spur gear 35. The gears 25, 35 are selected so that when the roll 8 is displaced upwardly away from the roll 9 the gears 25, 35 remain meshed and the rolls 8, 9 continue rotating in opposite directions.

In use, the bar 1 is cut to a discrete length and is fed through a pair of guide rollers 44 into the nip of the rolls S, 9 while the rolls are rotating. As the bar 1 passes through the nip of the rolls the pegs 9 periodically pinch the metal of the bar 1 to form the lobes 2 therein. This is achieved in a single pass of the bar 1 through the rolls 8, 9 in the cold condition of the bar. (Owing to the size of the drawings, the lobes 2 are not shown on the bar 1 in FIGS. 2*a* and 2*b*. They are, however, shown in FIGS. 3*a* and 3*d*). The rolls 8, 9 are controlled to ensure that the lobes 2 are formed only on the section 2 of the bar. In this embodiment of the invention this is achieved by means of a pair of sensing devices 45, 46 mounted ahead of and behind the rolls 8, 9.

The sensing device 46 mounted behind the rolls 8, 9 comprises a support 47 carrying a retractable stop member 48 and a sensor 44 (FIG. 3*b*). The support 47 also carries two pairs of dependent guides 50, 51 through which the bar 1 moves. The sensing device 45 mounted ahead of the rolls 8, 9 is the same as the sensing device 2, 3 but the retractable stop member 48 may be omitted.

With the roll 8 in an open position displaced from the roll 9, the bar 1 is advanced freely therebetween. As the leading end of the bar enters the sensing device 46 located behind the rolls 8, 9 the sensor 49 of the device 46 causes the stop member 48 to retract and activates the hydraulic ram 30 to cause the roll 8 to close to the position shown in FIG. 4. The bar 1 advances further through the rolls 8, 9 as the lobes 2 are formed thereon and as the trailing end of the bar leaves the sensing device 45 it de-activates the hydraulic ram 30 which causes the roll 8 to open under the action of the coil springs 34. The sensing devices 45, 46 are adjustable in the direction of the path of the bar 1 and hence the sections of the bar which are free of lobes 2 and which carry lobes 2 can be selected by forward and rearward adjustment of the sensing devices 45, 46. In addition, the sensing devices 45, 46 may be used to actuate timers in order to delay activation and de-activation of the hydraulic ram 30 and thereby to permit further variations to be obtained in the sections of the bar which are free of lobes and which carry lobes.

The driven rollers 15, 17 and 19 serve to advance the bar 1 along its path through the apparatus 6. To maintain pressure between opposing sets of driven rollers 15, 17 and 19, pneumatic heads 54 are provided which carry the upper rollers in the sets. Each head 54 has a dependant rod 55 which connects to a mounting 56 which carries the associated roller and which is slidable in a guide 57 (FIG. 3*c*).

As the bar passes between the straightening rollers 16 it is straightened in a vertical plane and as it passes between the straightening rollers 18 it is straightened in a horizontal plane. The rollers 18 have central channels 58 formed therein to accommodate the lobes 3 on the bar as it passes between the rollers (FIG. 3*d*).

Each of the straightening rollers 16, 18 is adjustable towards and away from its opposing rollers to enable its effect on the bar 1 to be varied. For this purpose each straightening roller 16, 18 is mounted on a slide 60 which is slidable in a guide 61 and is adjustable by means of a setting bolt 62 (FIG. 3*e*). The slide 60 is secured by lock nuts 63, 64. In a preferred form, the rollers, 16, 18 will be so adjusted that a flexing of the bar 1 takes place as it passes between the rollers.

Once the bar 1 has passed through the apparatus 7, the thread 5 is rolled onto the section 4 of the bar in conventional manner.

A chute 65 is positioned beneath the rolls 8, 9 to collect scale generated by the action of the rolls on the bar 1.

The manner of forming the lobes 2 on the bar 1 described above is relatively simple and inexpensive and the apparatus 7 can maintain speeds of the bar 1 passing therethrough of at least 35 m/min.

In this embodiment of the invention the lobes 2 are formed in a single plane but if desired they can be formed in two or more planes.

Figure 2B:
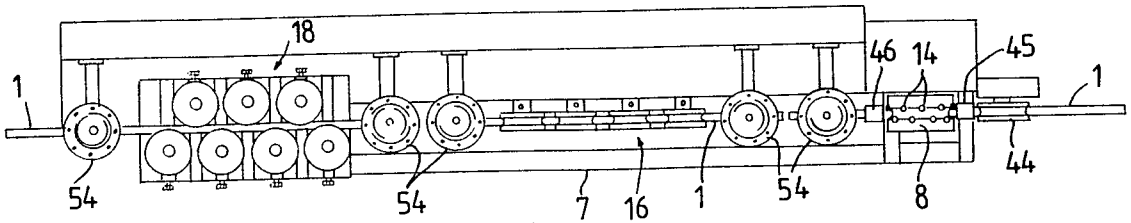

In an alternative form, a continuous length of the bar 1 may be fed through the apparatus shown in FIGS. 2*a* to 2*b*. in such a case the roll 8 is periodically displaced away from and towards the roll 9 to ensure that extrusion takes place only on consecutive selected sections of the bar. Once the bar has passed through the apparatus, it is cut into the required lengths and threads are rolled on to the individual lengths in conventional manner.

Figure 6A:
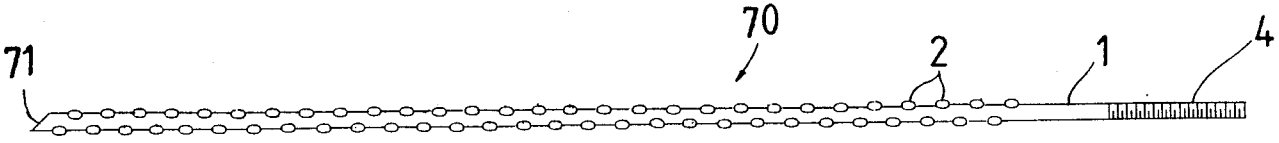
FIGS. 6*a* and 6*b* show two different kinds of rock bolts made according to the invention.
Figure 6B:
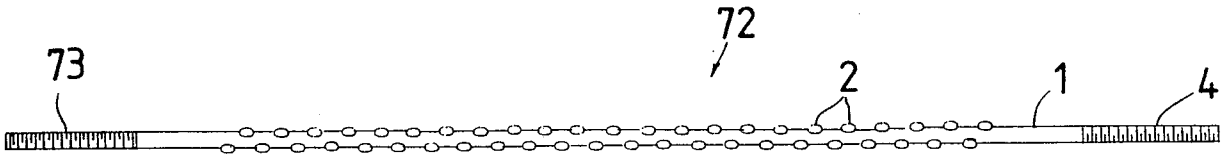

In FIGS. 6*a* and 6*b* two rock bolts made according to the invention are shown. The rock bolt 40 shown in FIG. 4*a* is intended for embedding in a resin mixed with a catalyst. It has thread 4 formed at one end thereof to receive a nut (not shown). At its other end it has a chamfered point 71 which is used to rupture a capsule containing the resin (not shown) located in the hole in the rock matrix in which the bolt is to be embedded.

The rock bolt 72 shown in FIG. 4*b* is similar to the one shown in FIG. 4*a* but instead of the point 71 it has a thread 73. The thread 73 is used to connect the rock bolt to a conventional mechanical anchor (not shown) which expands when the rock bolt is tensioned to anchor it in a hole. In addition to the mechanical anchor, a resin or concrete can be used to grout the rock bolt 72 in the hole.

Where a rock bolt made according to the invention is to be embedded in a settable material mixed with a catalyst, the rock bolt will, in use, be rotated about its axis to assist in mixing of the settable material. The lobes 2 on the bolt will in such a case assist considerably in mixing the settable material by causing lateral displacement of the settable material during rotation of the bolt. In this regard, any particle situated adjacent the bolt between two lobes 2 will be displaced by the lobe on the opposite side of the bolt when it is rotated. The improved mixing ability of the bolt arises from the fact that with the use of the lobes 2, the diameter of the bolt at the apices of opposed lobes can be as much as 1,5 times the diameter of the bolt. It will also be appreciated whilst the rock bolt of the invention provides a continuously changing perimeter along its length, the provision of the lobes 2 thereon does not materially alter its cross-section along its length. This means that the provision of the lobes does not result in a sacrifice of cross-section and hence does not affect the tensile strength of the rock bolt.

With the method of making a rock bolt in accordance with the invention the machining or shaving step in the prior art method described above, is dispensed with. In addition, a substantial saving of material can be obtained with a rock bolt made according to the invention, when regard is had to the following. The diameter of the ribbed section of the prior art rock bolt is larger than the diameter (e) thereof. Yet this larger diameter does not increase the tensile strength of the prior art bolt, since the tensile strength is determined by the minimum diameter of the thread (f). The prior art rock bolt therefore carries excess material over the length of its ribbed section. In the rock bolt made according to the invention, such excess material is limited since the diameter of the bar 1 is in the first place chosen to equal the pitch diameter of the thread 4. In this way a saving of material in excess of 25% can be achieved compared with a prior art rock bolt, which results in a less expensive rock bolt when made according to the method of the invention.

It is well known that the load capacity of the anchorage provided by a rock bolt embedded in a settable material such as concrete is proportional to the perimeter of the bolt. To ensure that a rock bolt according to the invention does not have a lesser anchorage capacity compared with a conventional rock bolt, the perimeter of the bar 1 may be increased during or after the operation in which the lobes 2 are formed in the bar. This may be done, for example, by changing the cross-section of the bar in the lobe forming operation from a circular to an elliptical shape.

Thus, the rock bolt of the invention formed in this way from a bar of smaller cross-section than that of a conventional rock bolt, can provide the same anchorage capacity a the conventional rock bolt.

The rock bolt of the invention can also be made from pipe or metal bar with an axial bore, for use in applications where settable material is injected through the rock bolt itself. Also, any part of the rock bolt of the invention may be left free of lobes 2, if required.

The invention has particular application to rock bolts which are provided in lengths in which the lobed section is longer than 1 meter.

Other embodiments of the invention may be made without departing from the scope of the invention as defined in the appended claims.

We claim:

1. A method of making a rock bolt with a thread on a section thereof comprising the steps of;

providing a metal bar of circular or near circular cross-section having a diameter which is substantially equal to the pitch diameter of the thread to be provided thereon;

passing the bar in a single pass between a pair of rolls to pinch the bar at intervals to cold form protrusions spaced from one another in staggered formation on opposite sides of the bar along a selected section thereof;

displacing one or more of said rolls away from the other at a selected time to ensure that said protrusions are formed only on said selected section of bar;

straightening the bar in its cold condition; and cold rolling a thread with the said pitch diameter on a further selected section of the bar which is free of the said protrusions.

2. A method according to claim 1 wherein the bar is straightened in two planes by passing the bar sequentially through two sets of rollers, the rollers of one set being located at right angles to those of the other set, the rollers of each set being located in staggered, opposed relationship.

3. A method according to claim 1 wherein one of said rolls, being mounted on a shaft, is displaced away from the other of said rolls by pivotting said shaft about a pivot.

4. A method of making a rock bolt with a thread on a section thereof comprising the steps of;

providing a metal bar of circular or near circular cross-section having a diameter which is substantially equal to the pitch diameter of the thread to be provided thereon;

cold forming a series of flat lobes spaced from one another in staggered formation on opposite sides of the bar along a selected section of the bar by passing the bar in a single pass through a pair of rolls, the rolls defining a nip between them and having formations provided at predetermined positions along their peripheries, the rolls being rotated in opposite directions so that a formation on one roll coincides periodically with a formation on the other roll in the nip of the rolls, the bar being fed lengthwise through the nip of the rolls so that the formations pinch the metal of the bar to form said flat lobes along said selected section thereof;

displacing one or more of said rolls away from the other at a selected time to ensure that said lobes are formed only on said selected section of the bar;

straightening the bar in its cold condition in two planes by passing the bar sequentially through two sets of rollers, the rollers of one set being located at right angles to those of the other set, the rollers of each set being located in staggered, opposed relationship; and cold rolling a thread with the said pitch diameter on a further selected section of the bar which is free of the said lobes.

5. A method according to claim 4 wherein the flat lobes are formed on substantially the entire length of the bar, save for the selected section on which the thread is formed.

6. A method according to claim 4 wherein one of said rolls, being mounted on a shaft, is displaced away from the other of said rolls by pivotting said shaft about a pivot.

* * * * *